US005666623A

United States Patent [19]

Yamada et al.

[11] Patent Number: 5,666,623

[45] Date of Patent: Sep. 9, 1997

[54] FUSING BELT TYPE HEAT FUSING DEVICE

[75] Inventors: Tetsuya Yamada; Mitsuru Isogai; Takashi Yamada, all of Aichi-Ken; Satoru Yoneda, Toyohashi, all of Japan

[73] Assignee: Minolta Co., Ltd., Osaka, Japan

[21] Appl. No.: 654,889

[22] Filed: May 29, 1996

[30] Foreign Application Priority Data

Jun. 6, 1995 [JP] Japan ..... 7-138966

[51] Int. Cl.[6] ..... G03G 15/20

[52] U.S. Cl. ..... 399/320; 219/216; 399/116; 399/325; 399/367

[58] Field of Search ..... 355/282, 283, 355/285, 308, 309, 212, 271, 290, 295; 219/216, 469–471; 432/60; 118/60; 399/320, 325, 326, 367, 116, 329; 271/3.01

[56] References Cited

U.S. PATENT DOCUMENTS 3,948,215 4/1976 Namiki ..... 118/60
4,563,073 1/1986 Reynolds .
4,973,824 11/1990 Ohashi et al. ..... 219/216
5,027,160 6/1991 Okada et al. .
5,115,279 5/1992 Nishikawa et al. .
5,465,146 11/1995 Higashi et al. ..... 355/285
5,493,371 2/1996 Kutsuwada et al. ..... 355/271

FOREIGN PATENT DOCUMENTS 6-318001 11/1994 Japan .

*Primary Examiner*—Shuk Lee
*Attorney, Agent, or Firm*—Burns, Doane, Swecker & Mathis, LLP

[57] ABSTRACT

A fusing belt type heat fusing device has a rotating fusing roller, a driven heating roller, an endless fusing belt wrapped and stretched around the two rollers, a pressure roller that applies pressure to the fusing roller through the fusing belt, and a separation agent application and tension transmission element that applies an offset suppression separation agent to the fusing belt in addition to transmitting tension to the fusing belt. The separation agent application and tension transmission element is installed so as to make contact with the fusing belt at an upstream side of the heating roller in the rotation direction of the fusing belt between the fusing roller and the heating roller and at a position closer to the heating roller than a center position between the fusing roller and the heating roller.

40 Claims, 7 Drawing Sheets

FUSING BELT TYPE HEAT FUSING DEVICE

BACKGROUND OF THE INVENTION

1. Field of Industrial Use

The present invention relates to a fusing device for an image forming apparatus, such as an electrophotographic copying machine or printer.

2. Description of Related Art

Conventionally, a fusing device that fuses a toner image that was transferred to a recording material such as a transfer paper (recording paper) onto the recording material has been incorporated in an electrophotographic image forming apparatus. For this fusing device, a device is normally utilized in which toner is heated, pressurized and then fused onto the recording material.

Various fusing devices of this type have been proposed and utilized up to now and one of these currently being utilized is called a fusing belt type heat fusing device. In Japanese Unexamined Laid-open patent HEI 6-318001, one example of a fusing belt type heat fusing device has been proposed. As shown in FIG. 6, this fusing device is comprised by a fusing roller 91, a heating roller 92, a fusing belt 93, and a pressure roller 94. The fusing roller 91 maintains a fixed gap with the heating roller 92 and is disposed parallel to the heating roller 92. The fusing belt 93 is an endless type belt and is wrapped around the fusing roller 91 and the heating roller 92. The pressure roller 94 makes contact with the fusing roller 91 through the fusing belt 93.

In the fusing device of FIG. 6, the fusing roller 91 is rotated in the direction of arrow a in the figure by means of a drive means (not shown in the figure). The fusing belt 93 also moves in the same direction following the rotation of the fusing roller 91 which drives the heating roller 92 and the pressure roller 94 to rotate. Further, along with the rotation of the fusing roller 91, each portion of the fusing belt 93 is heated by means of the heating roller 92 prior to arriving at a nip portion 95 between this belt and the pressure roller 94. Recording material S1 on which is transferred a toner image T1 is passed through the nip portion 95. The toner image T1 is fused to the recording material S1 by the heat of the fusing belt 93 and the pressure between the belt and the pressure roller in the nip portion 95. Moreover, guide rings 96 are provided on both ends of the heating roller 92. The fusing belt 93 is guided by these guide rings 96 preventing the belt from moving diagonally.

Furthermore, in this fusing device a tension roller 97 makes contact with the upstream side of the heating roller in the fusing belt movement direction against the outer surface of the fusing belt 93. The tension roller 97 functions both to supply offset suppression oil and to clean the belt. The belt surface on the side (downstream of the fusing belt 93 in the figure) that is preheated by means of driving the fusing belt 93 by the fusing roller 91 is deemed the stretched side 931 which transmits tension to the heated surface of the belt.

For the fusing device of Japanese Unexamined Laid-open patent HEI 6-318001, the tension roller 97 makes contact with the loose side 932 of the belt 93 which is a nonheated surface. The inventors found that on the loose side 932 of the belt 93, there was traveling unevenness of the belt (belt jumping) such as rising and falling waves on the ideal belt advancing surface of the fusing belt 93. It was confirmed that this traveling unevenness of the belt caused a sinking portion 933 that sinks toward the heating roller 92 of the fusing belt 93, and further resulting in the end surface 934 of the fusing belt 93 very unnaturally rubbing against the guide rings 96, and belt twisting occurring more easily. Thereby, problems such as the occurrence of edge cracks 935 on the belt 93, and rippling 936 caused damage to the belt. It was confirmed that when the distance between the tension roller 97 and the heating roller 92 was increased, this problem was more obvious.

It was further confirmed that because the fusing belt 93 jumps, a stable application of separation agent from the tension roller 97 to the fusing belt 93 could not be performed.

The above-mentioned problem of damage to the belt is not a problem restricted to the belt feed mechanism in a fusing device. It also occurs in the belt feed mechanism utilized in a document feed device and a belt feed mechanism utilized in a belt photoreceptor.

OBJECTS AND SUMMARY

An object of the present invention is to provide a belt feed device that can achieve a longer life of the belt. A further object of the present invention is to provide a belt feed device that can achieve stable travel of the belt.

An even further object of the present invention is to provide a fusing belt type heat fusing device that can achieve stable heating of the fusing belt.

And, an even further object of the present invention is to provide a fusing belt type fusing device that can stably apply a separation agent to the fusing belt without unevenness.

According to a preferred embodiment of the present invention, a fusing belt rotates and travels between a fusing roller and a heating roller in a suitably stretched state by means of a separation agent application and tension transmission means, along with the drive rotation of the fusing roller with the heating roller being driven to rotate.

After applying the offset suppression separation agent at an upstream side of the heating roller to the belt that will travel by means of the separation agent application and tension transmission means, the belt is preheated by the heating roller and then arrives at the fusing roller, further proceeding to the nip portion between the pressure roller and the belt. Along with this, a toner image is fused by means of heat accumulated on said belt portion and under pressure by the pressure roller to the recording material on which the toner image is maintained. The transfer, or namely the offset, of the toner to the fusing belt is suppressed by the separation agent.

In this fusing device, because the heating of the fusing belt is done after the application of a separation agent by means of the separation agent application means, which also functions as the above-mentioned tension transmission means, the temperature of the fusing belt is stabilized and the more the temperature is stabilized, the more favorably the fusing of the toner image is carried out.

Furthermore, although the separation agent application and tension transmission means is arranged on the upstream side of the heating roller, it is arranged at a position closer to the heating roller than the fusing roller. Thus, the traveling unevenness of the fusing belt (belt jumping) close to the heating roller is suppressed thereby allowing the fusing belt to smoothly travel with more stability increasing the life of the belt.

Furthermore, because contamination caused by paper particles and toner, etc. on the fusing belt adheres to a separation agent application roller that makes contact with the fusing belt, but does not directly adhere to the member that supplies the separation agent to said roller, the separation agent can be supplied from a separation agent supply member to the application roller with even less unevenness thereby allowing the separation agent to be stably applied to the fusing belt with less application unevenness. This allows offset to be suppressed as well as the fusing belt to be cleaned thereby obtaining a favorable fused image.

Moreover, when a cleaning member is brought into contact with the separation agent application roller as stated above, contamination adhering to the separation agent application roller is caught on said cleaning member to either prevent the contamination from moving to the separation agent supply member or sufficiently control it, thereby allowing both the separation agent to be stably applied to said belt with even less unevenness as well as sufficiently suppressing the offset while cleaning the contamination of the fusing belt.

According to the present invention, as described herein, the fusing belt type heat fusing device can be provided in which a stable travel and longer life of the fusing belt is achieved in addition to achieving stable heating of the fusing belt and because of these, favorable toner image fusing can be obtained extending over a long period to that extent.

Furthermore, the fusing device according to this invention can be further provided so that a stable application of a separation agent to the fusing belt with less unevenness to obtain even more favorable toner image fusing compared to when the separation agent supply member, which is saturated with an offset suppression separation agent, is brought into direct contact with the fusing belt and the separation agent is applied to the fusing belt.

Even further, in this fusing device, when the cleaning member is brought into contact with the separation agent application roller to which a separation agent is supplied from the separation agent supply member, contamination adhering to the separation agent application roller is caught on said cleaning member to either prevent the contamination from moving to the separation agent supply member or sufficiently suppress it, thereby allowing both the separation agent to be stably applied to said belt with even less unevenness as well as sufficiently suppressing the offset while cleaning the contamination of the fusing belt.

DETAILED DESCRIPTION OF THE PREFERRED EMBODIMENTS

Figure 1:
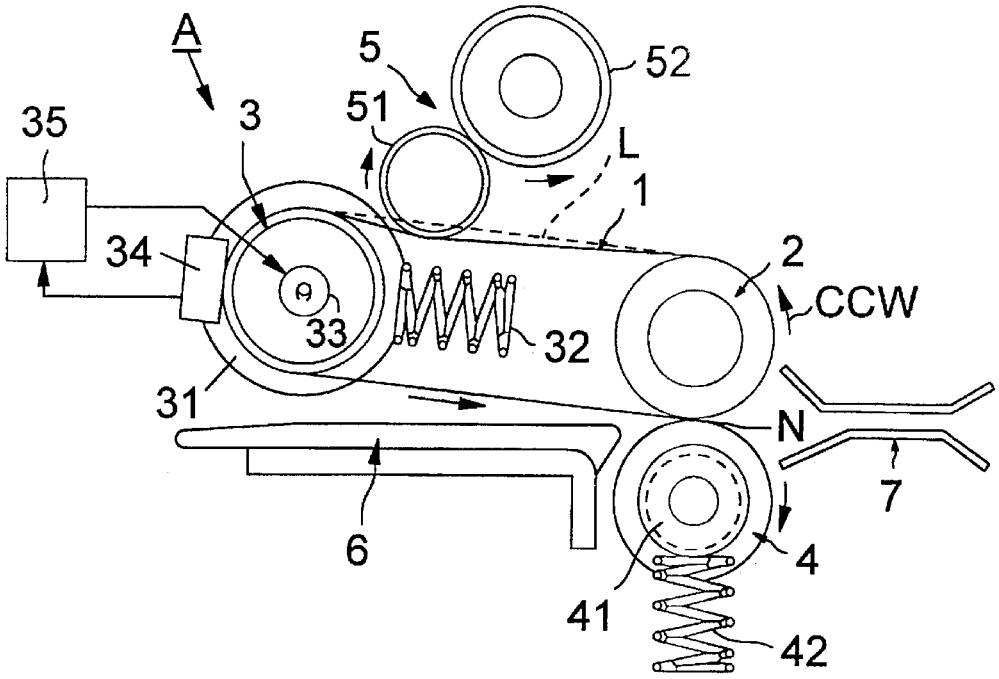
FIG. 1 is a side-view showing the construction of a first embodiment of the fusing device related to this invention.

Referring now to the drawings, a preferred embodiment of the present invention will be described. FIG. 1 is a side-view showing an outline of a first embodiment of the present invention and FIG. 2 is a perspective view thereof.

Figure 2:
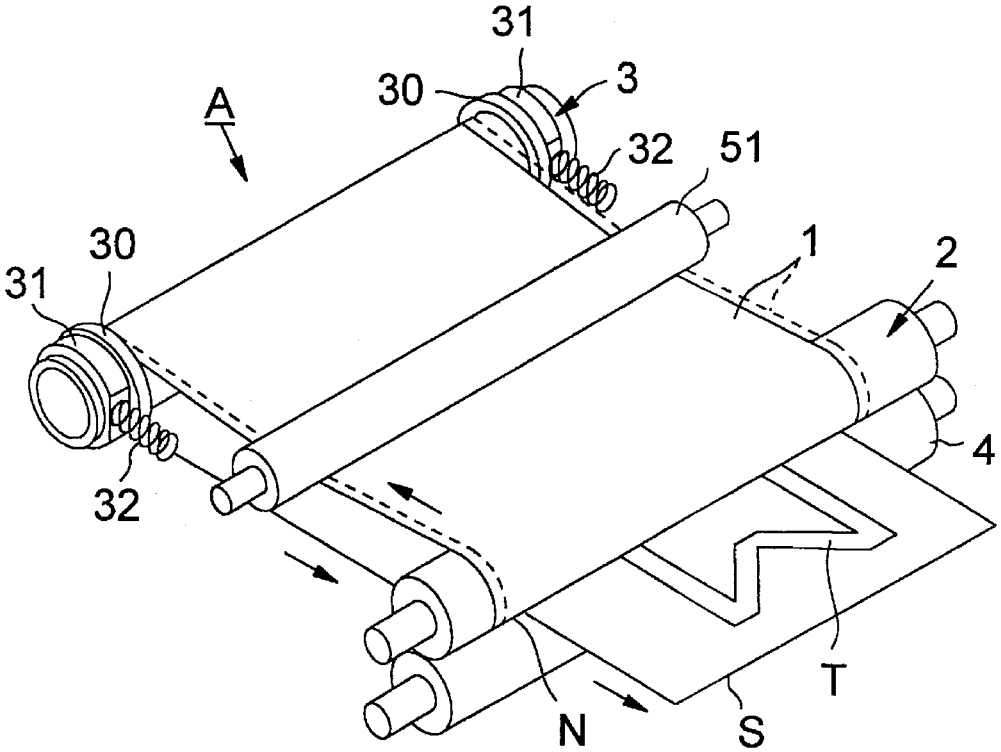
FIG. 2 is a perspective view showing the fusing device shown in FIG. 1.

The heat fusing device A shown in FIG. 1 and FIG. 2 is incorporated into an electro-photographic image forming apparatus. The fusing device A includes a fusing belt 1, a fusing roller 2, a heating roller 3, a pressure roller 4, and an oil application device 5.

The oil application device 5 is a device that applies a silicon oil which is the offset suppression separation agent to the surface of the belt 1 along with applying a fixed tension to the belt 1.

The fusing belt 1 is an endless belt wrapped and stretched around the fusing roller 2 and the heating roller 3. Here, the fusing roller 2 and the heating roller 3 are substantially parallel to each other.

The fusing roller 2 is rotatably supported by a pair of bearings (not shown in the figure) and is driven to rotate in the counter clockwise direction in the figure (direction of arrow CCW) by a drive means (not shown in the figure) such as a motor.

The heating roller 3 is rotatably supported by a pair of heating roller bearings 31. These bearings 31 are supported by bearing support members (not shown in the figure) that allow them to approach and move away from the fusing roller 2. Further, springs 32 apply a fixed force to keep the bearings 31 at a distance away from the fusing roller 2. The heating roller 3 is provided with flange shaped guide ring portions 30 on both ends. These guide ring portions 30 function to prevent offset of the fusing belt 1.

Moreover, the heating roller 3 is provided with a heater 33 within its tubular center. A thermistor 34 is arranged on the belt portion of the heating roller 3 as a belt temperature detector. The thermistor 34 is connected to a temperature controller 35. This temperature controller 35 is connected to the heater 33. The signals detected by the thermistor 34, namely the signals which indicate the temperature of the belt, are input to the temperature controller 35 and the temperature controller 35 controls the heater 33 based on these signals and a belt temperature set beforehand to fuse the toner image bringing the temperature of the belt 1 close to the set temperature.

The pressure roller 4 is rotatably supported by a pair of pressure roller bearings 41. These bearings 41 are supported by bearing support members (not shown in the figure). These bearing support member allow the bearings 41 to approach and move away from the fusing roller 2. Further, springs 42 apply a fixed force in a direction in which the bearings 41 make contact with the fusing roller 2. The oil application device 5 includes a roller 51 and an oil supply member 52. The roller 51 applies a silicon oil to the surface of the fusing belt 1 along with applying a fixed tension to the fusing belt 1. The oil supply member 52 is a roller shape and makes contact with the roller 51 supplying silicon oil to the roller 51. The roller 51 and the oil supply member 52 are rotatably supported by a holder member (not shown in the figure). Moreover, the roller 51 is disposed on the holder member such that it is arranged at a fixed position relative to the fusing belt 1. Conversely, the oil supply member 52 is provided to the holder member such that it can be attached and removed in order to allow replacement or oil replenishment.

The roller 51 is arranged between the fusing roller 2 and the heating roller 3 in the rotation direction (direction of arrow CCW in the figure) of the fusing belt 1 on the upstream side of the heating roller 3 as well as on the downstream side of the fusing roller 2. More particularly, the roller 51 is arranged such that it makes contact with the fusing belt 1 at a position closer (in this embodiment a position close to the heating roller 3) to the heating roller 3 than a central position between the fusing roller 2 and the heating roller 3.

Further, as shown in FIG. 1, the roller 51 is arranged on the inside of a common tangent line L that connects surfaces of the fusing roller 2 and the heating roller 3. Therefore, the roller 51 works together with the spring 32 which acts on the heating roller 3 to apply tension to the fusing belt 1 while at the same time the fusing belt 1 makes contact along the outer periphery of the roller 51. By means of the mutual contact state between this belt 1 and roller 51, the roller 51 and the belt 1 can maintain a large nip width with a relatively small contact pressure.

In addition, a fusing front guide 6 is provided underneath the fusing belt 1. The fusing front guide 6 is arranged at a position and an angle which allow it to traverse toward the nip portion N between the belt 1 and the pressure roller 4 without the recording material S that supports toner image T touching the fusing belt 1. Further, a delivery guide 7 is provided behind the nip portion N.

In the fusing device A having the above-mentioned construction, the fusing roller 2 is driven to rotate in the direction of arrow CCW by the drive means. The driven rotation of the fusing roller 2 is transmitted to the fusing belt 1 by frictional force and the fusing belt 1 moves in the same direction as the fusing roller 2. The heating roller 3, the pressure roller 4 and the roller 51 are all driven to rotate along with the movement of the fusing belt 1.

Moreover, in addition to when the fusing roller 2 is driven to rotate directly by a drive means as described above, driving the above-mentioned pressure roller 4 to rotate by a drive means which in turn drives the fusing roller 2 to rotate via the fusing belt 1 can also be considered for the driven rotation of the fusing roller 2. For either of these cases, the heating roller 3 will be a driven roller with respect to the fusing roller 2.

The material of each member will be described next. The fusing belt 1 is an endless belt made of nickel and has a thickness of 40 μm. Although the material of the fusing belt 1 is not restricted to this, a material that can radiate heat such that the toner image is not heated more than necessary so offset does not occur is preferable. It is preferable to use a material with a comparatively small thermal capacity per each unit area as the material of the belt. Further, a silicon rubber with a thickness of 150 μm is used as a heat resistant separation layer to cover the surface (outer peripheral surface) of the fusing belt 1. For the heat resistant separation layer, tetra fluoroethylene resin layer can be used in addition to silicon rubber.

The fusing roller 2 is covered on the metallic core bar by a silicon sponge having heat resistant and elastic properties.

The pressure roller 4 is formed by silicon rubber having a surface layer with heat resistant and moderate elastic properties. Hereupon, the mutual relationship in terms of the surface hardness between the fusing roller 2 and the pressure roller 4 is set to (pressure roller 4)≧(fusing roller 2). This relationship in terms of the hardness is set in order that the recording material S is discharged smoothly from the nip portion N between the pressure roller 4 and the fusing belt 1 after the toner image is fused. The setting is such that while the recording material S bends in a direction opposite to the direction along the peripheral surface of the fusing roller 2 or is sent out flat, the pressure roller 4 slightly cuts into the fusing roller 2 via the fusing belt 1 or is brought into contact with the roller in a state close to that.

The heating roller 3 is constructed using aluminum pipe and undergoes alumite processing to prevent wear.

The roller 51 is formed by covering a metallic core bar with silicon rubber that has good affinity with silicon oil. The silicon oil is evenly applied to the surface of the silicon rubber of the roller 51 by means of the oil supply member 52. Further, the surface of the silicon rubber of the roller 51 is made rougher (surface roughness of the fusing belt 1 has a center line average roughness of Ra0.1 and the surface roughness of the roller 51 is Ra0.5) than the surface roughness of the fusing belt 1 in order to make contamination from the fusing belt 1 adhere to the surface of the silicon rubber resulting in a tendency for the contamination separation characteristics to worsen. Further, along with adding a difference in the surface roughness between the roller 51 and the fusing belt 1, a silicon rubber material with contamination separation characteristics worse than the fusing belt 1 can be used as the roller 51 surface material in place of adding a difference.

The oil supply member 52 has heat resistant paper impregnated with silicon oil wound around the surface of the metallic core bar and on its surface is provided with a synthetic leather layer that regulates the amount of silicon oil application.

According to the heat fusing device A that utilizes the fusing belt system described above, the fusing belt 1 travels by means of the driven rotation of the fusing roller 2 and the pressure roller 2 which makes contact with the heating roller 3 and the belt 1 is driven to rotate.

The pressure roller 4 forms the nip N between itself and the fusing belt 1 by means of the bearing 41 being pressed by the spring 42 toward the fusing roller 2.

Silicon oil is applied to the traveling fusing belt 1 at the upstream side of the heating roller 3 by means of the roller 51. After the silicon oil is applied, the fusing belt 1 is heated by means of the heating roller 3. After the belt is heated, the fusing belt 1 travels over the fusing front guide 6 progressing to the nip portion N between the belt and the pressure roller 4. Conversely, the recording material S that maintains toner image T is sent in the direction of the nip portion N while being led by the fusing front guide 6. The recording material S maintains is spaced from the fusing belt 1 while traveling over the fusing front guide 6 before reaching the nip portion N. At this time, the toner image on the recording material S is moderately softened beforehand by means of the heat of the opposing belt portion. Therefore, the recording material S penetrates into the nip portion N in a state in which the toner is softened. The toner on the recording material S is sufficiently heated and pressurized in the nip portion N and is fused to the recording material S. The transfer of the toner to the fusing belt 1 or, in other words, the offset, is suppressed by means of applying oil to the surface of the fusing belt 1. After the toner image has been fused to the recording material S, the recording material S is guided by the delivery guide 7 and then delivered.

In this fusing device A, because the heating of the fusing belt 1 is carried out after the application of the oil, the temperature of the fusing belt 1 is stabilized realizing favorable fusing of the toner image. In the case where the oil is applied after the heating of the fusing belt, the temperature of the fusing belt does not stabilize because the heat of the fusing belt is displaced onto either the oil application roller or the oil which was applied after heating of the fusing belt.

Further, the roller 51 makes contact with the fusing belt 1 between the heating roller 3 and the fusing roller 2. Therefore, the nip width between the roller 51 and the fusing belt 1 can be made sufficiently large even if the pressure towards the fusing belt 1 is not made large. Therefore, efficient oil application to the fusing belt 1 as well as efficient removal of contamination from the fusing belt 1 is achieved without increasing the traveling resistance of the fusing belt 1.

Moreover, the roller 51 makes contact with the fusing belt 1 at an upstream position of the heating roller 3 and at a downstream side (namely, the loose side of the fusing belt 1) of the fusing roller 2. Because this contact position is close to the heating roller 3, the travel unevenness (belt jumping) of the fusing belt 1 in the periphery of the heating roller 3 is suppressed. Therefore, the fusing belt 1 travels smoothly and stably resulting in an improved life of the fusing belt 1.

Furthermore, contamination caused by paper particles and toner on the fusing belt 1 adheres to the roller 51 which makes contact with the fusing belt 1 and does not directly adhere to the oil supply member 52, thereby allowing a stable supply of oil from the oil supply member 52 to the surface of the roller 51 without unevenness as well as allowing the oil to be stably applied from the roller 51 to the belt 1 without application unevenness. As a result, the offset of the toner can be favorably suppressed allowing the fusing belt 1 to be cleaned also. Therefore, the image quality after the fusing can be maintained at a high quality.

As already described, in this fusing device A, the roller 51 is arranged at the upstream position of the heating roller 3 in the travel direction of the belt and is at the downstream side of the fusing roller 2 and a position closer to the heating roller 3 than the central position between the fusing roller 2 and heating roller 3. This position setting achieves more stable travel of the fusing belt 1. The preferable position settings of the roller 51 described above to achieve more stable travel of the fusing belt 1 are described below.

Figure 3A:
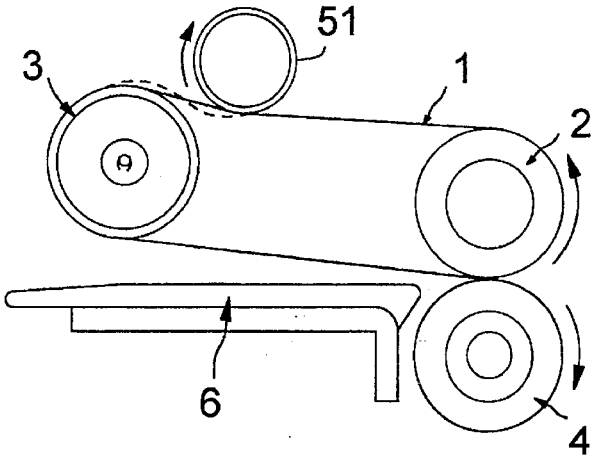
FIGS. 3(A), 3(B) and 3(C) describe the preferable set positions of the oil application and tension transmission roller.
Figure 3B:
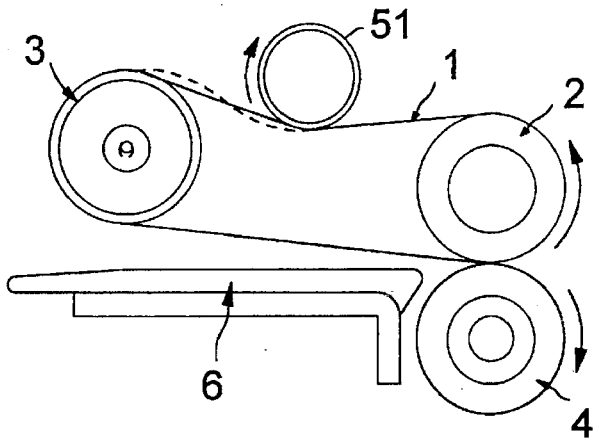
Figure 3C:
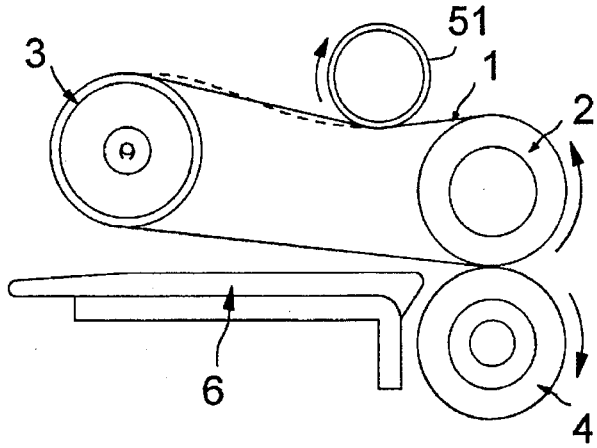

FIG. 3(A), FIG. 3(B) and FIG. 3(C) show the jumping state (see broken lines) of the fusing belt 1 dipping toward the heating roller 3 when the position of the roller 51 undergoes various changes. As understood from these figures, the closer the roller 51 moves toward the heating roller 3 side, the more stable the belt dipping becomes. In other words, the closer the roller 51 moves toward the heating roller 3 side, the less the jumping of the fusing belt 1 becomes. In the case where the roller 51 was set at a position closer to the fusing roller 2 than to the heating roller 3 (see FIG. 3(C)), when the fusing belt 1 was heated to 180° C. and made to rotate, cracks occurred on the end of the fusing belt 1 in approximately 80 hours. In the case where the roller 51 was set at a position at the midpoint between the heating roller 3 and the fusing roller 2 (see FIG. 3(B)), when the fusing belt 1 was made to rotate under the same conditions described above, the same phenomenon appeared on the fusing belt 1 in approximately 100 hours. In the case where the roller 51 was set close to the heating roller 3 (see FIG. 3(A)), cracks or rippling of the fusing belt 1 did not occur after approximately 400 hours of rotation as well. Therefore, it is understood that the preferred position of the roller 51 is closer to the heating roller 3 side than the position at the midpoint between the fusing roller 2 and the heating roller 3.

Next, referring now to FIG. 4, another preferred embodiment of the present invention will be described.

Figure 4:
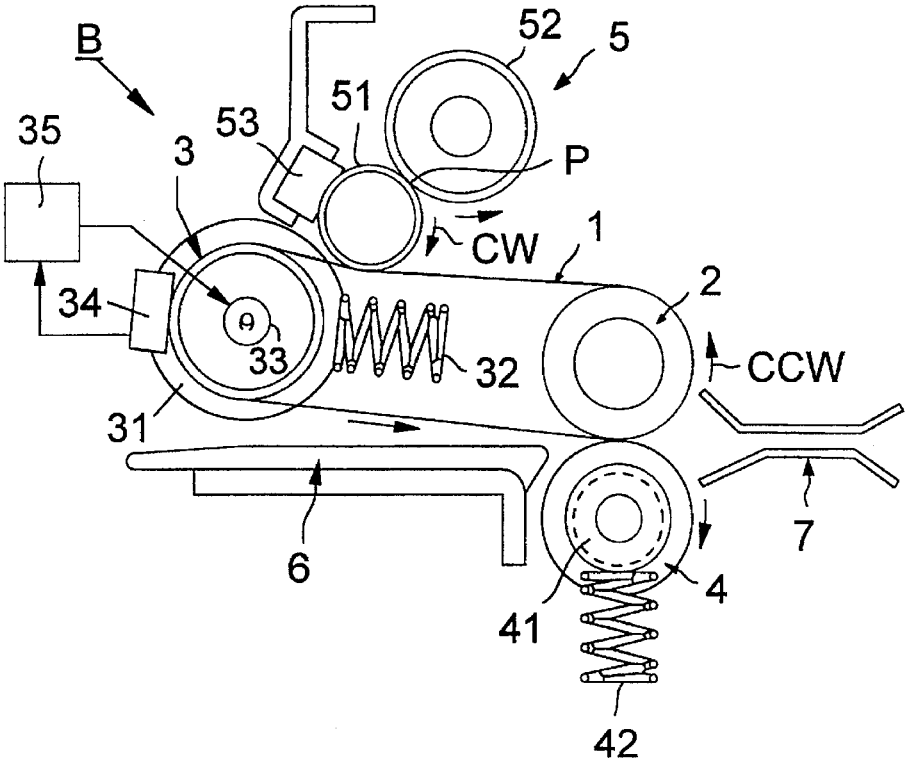
FIG. 4 is a side-view showing the construction of another embodiment of the fusing device related to this invention.

The construction of the heat fusing device B shown in FIG. 4 is different from the heat fusing device A of the first embodiment by the fact that the cleaning member 53 is brought into contact with the roller 51. The other construction of the fusing device B is practically identical to fusing device A. Moreover, in this embodiment, the same numbers are used for the members identical to the heat fusing device A of the above-mentioned first embodiment.

The cleaning member 53 makes contact with the roller 51 at a position upstream from the oil supply position P from the member 52 to the roller 51 in the rotation direction (direction of arrow CW in the figure) of the roller 51.

This cleaning member 53 is pad shaped and is comprised of a heat resistant felt. The cleaning member 53 catches paper particles and toner adhering to the roller 51. Further, the cleaning member 53 can obtain similar good effects utilizing a cleaning member that uses a material (for example heat resistant felt or a nonwoven fabric) that has a cleaning effect on the surface of the roller body or a blade-shaped cleaning member that uses fluororubber or metal. Moreover, for the shape of the cleaning member 53, in addition to the pad shape described above, a roller shape or a blade shape can be used as well.

Although this fusing device B operates in the same manner as in fusing device A, by providing the cleaning member 53, contamination adhering to the roller 51 is caught by said cleaning member 53 making it possible to either prevent or sufficiently suppress the transfer of the contamination to the member 52. Therefore, oil can be stably applied to said fusing belt 1 with even less application unevenness while cleaning the contamination of the fusing belt 1 thereby allowing the offset to be sufficiently suppressed.

The fusing device of this invention is contrasted with a fusing device of a comparative example with respect to the prevention of offset below. At first, as the fusing device of this invention, a fusing device A' was prepared that eliminated the roller 51 and brought the oil supply member 52 into direct contact with the fusing belt 1 in the fusing device A of the first embodiment. In like manner to the above-mentioned first embodiment, the set position of the oil supply member 52 in this fusing device A' was at the upstream side of the heating roller 3 and was at the downstream side of the fusing roller 2 close to the heating roller 3.

Figure 5:
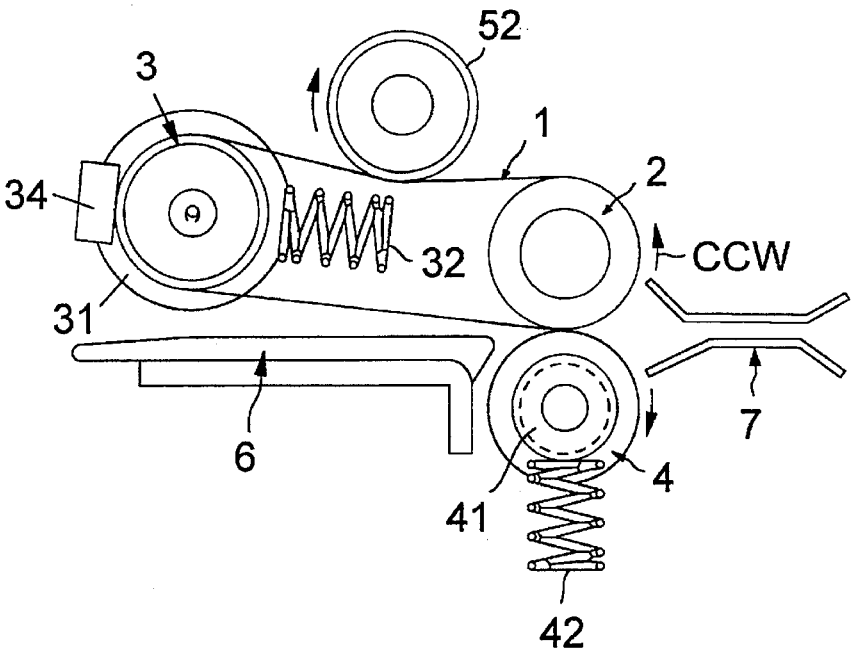
FIG. 5 is an outline side-view of a fusing device of a comparative example for examining the offset occurrence state.
Figure 6:
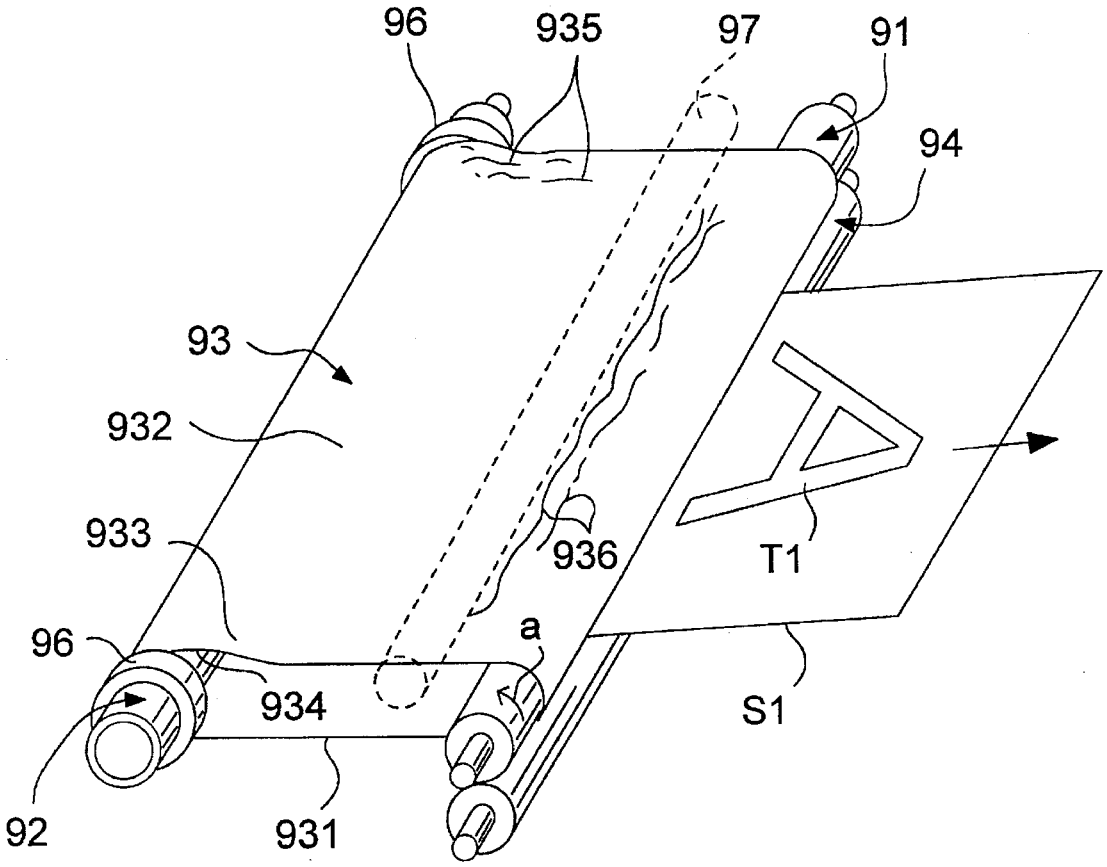
FIG. 6 is an outline side-view of a conventional heat fusing device that utilizes a fusing belt.

Conversely, as the fusing device of another comparative example, as shown in FIG. 5, a device was prepared in which the oil supply member 52 was arranged at the upstream side of the heating roller 3 and was at the downstream side of the fusing roller 2 at the center of both rollers 2 and 3.

In the fusing device of the FIG. 5 comparative example, when image formation was done on approximately 7000 sheets, offset occurred. Conversely, in the fusing device A', there was no occurrence of offset until image formation was done on approximately 20000 sheets. Further, in the fusing device B of the embodiment of FIG. 4, there was no occurrence of offset until image formation was done on approximately 30000 sheets.

The durability of the fusing belt and occurrence of offset in the fusing device of this embodiment and of a comparative example are summarized in Table 1.

TABLE 1

| | Time when damage occurred to the belt edge | Number of sheets when offset occurred |
|---|---|---|
| Device of FIG. 1 | No occurrence at 400 hours or more | App. 20000 sheets |
| Device of FIG. 3 (A) | | |
| Device of FIG. 3 | Cracks occurred in the | App. 20000 sheets |

TABLE 1-continued

| | Time when damage occurred to the belt edge | Number of sheets when offset occurred |
|---|---|---|
| | edge at 100 hours | |
| Device of FIG. 3 (C) | Cracks occurred in the edge at 80 hours | App. 20000 sheets |
| Device of FIG. 5 | Cracks occurred in the edge at 100 hours | App. 7000 sheets |
| Device of FIG. 4 | No occurrence at 400 hours or more | App. 30000 sheets |

Figure 7:
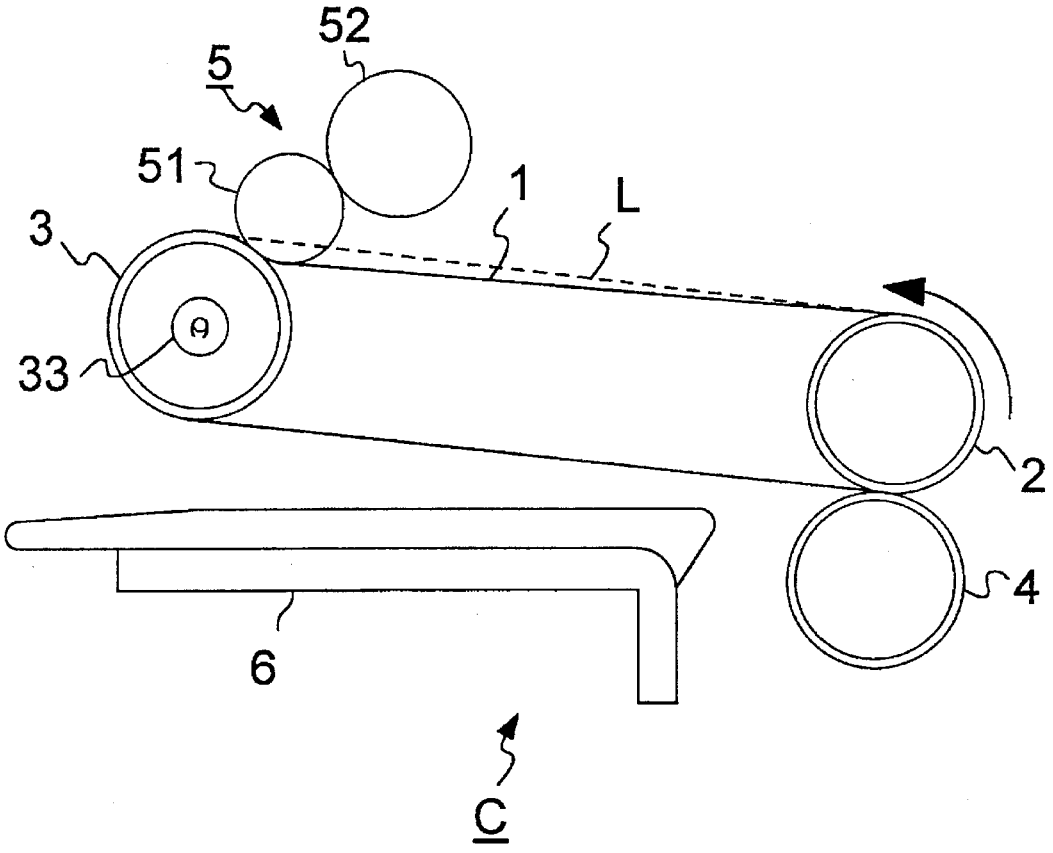
FIG. 7 is a cross-sectional view showing another embodiment of the fusing device related to this invention.

Further, the positions shown in FIG. 7 are considered as the set positions of the roller 51 in this invention. In the fusing device C of this figure, the roller 51 is at the upstream side of the heating roller 3 making contact with the fusing belt 1 at the downstream side of the fusing roller 2. In addition, the roller 51 makes contact with the fusing belt 1 closer to the heating roller side than the midpoint portion between the heating roller 3 and the fusing roller 2. However, this construction is different from the construction of the embodiments described above by the fact that one portion of the roller 51 makes contact with the heating roller 3 via the fusing belt 1. In the fusing device C of this figure, although one portion of the roller 51 makes contact with the heating roller 3 via the fusing belt 1, the roller 51 is arranged at a position where the fusing belt 1 is pressed into the inside of the common tangent line L. In addition, the position where the roller 51 presses the fusing belt 1 is the portion on the fusing belt 1 that dips into the heating roller 3. Therefore, jumping of the fusing belt 1 can also be prevented in the fusing device C of this figure along with allowing the nip width between the roller 51 and the fusing belt 1 to be sufficiently maintained.

Figure 8:
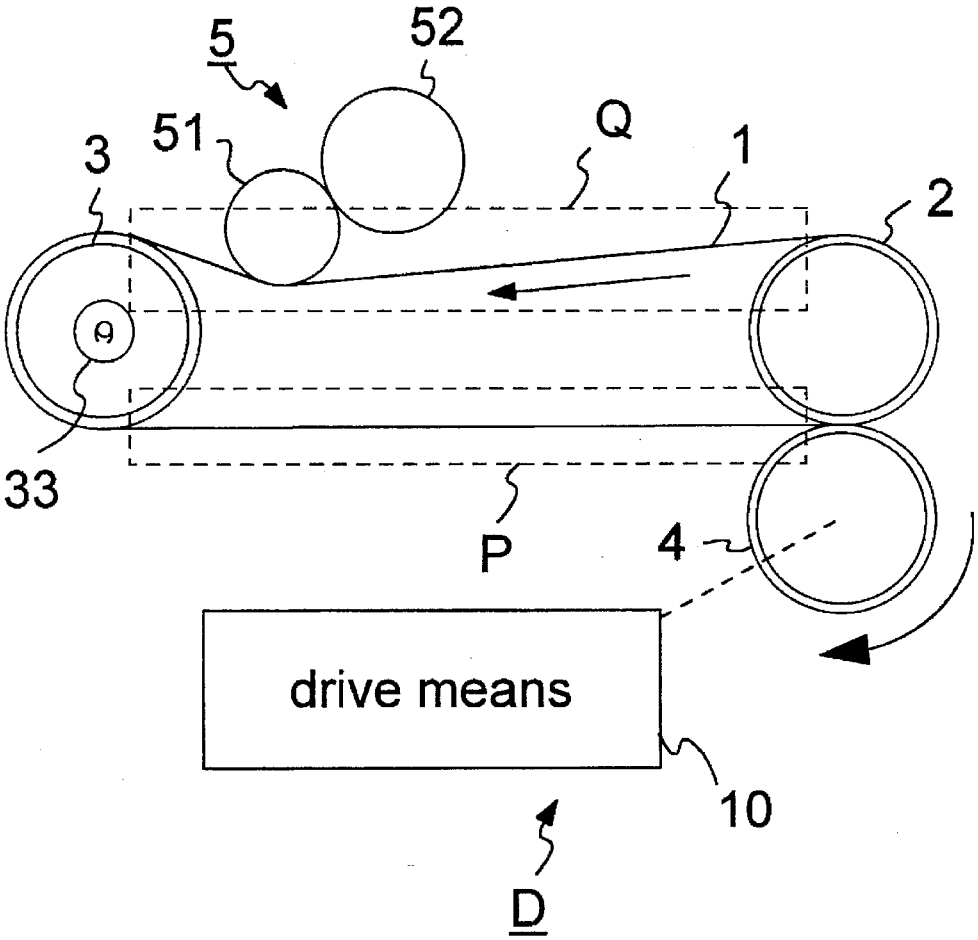
FIG. 8 is a cross-sectional view showing another embodiment of the fusing device related to this invention.

Further, the construction in which the fusing roller 2 and the heating roller 3 were provided along with the heating roller 3 being driven by the fusing roller 2 was described in the above-mentioned embodiments. However, this invention is not restricted to only this construction. For example, the construction shown in FIG. 8 can also be used. In the fusing device D of FIG. 8, a fusing roller 2 and a heating roller 3 are securely installed in connection with the rotation direction. Further, the fusing belt 1 is stretched around these rollers 2 and 3. In addition, a pressure roller 4 is rotatably provided opposite to the fusing roller 2 and this pressure roller 4 is driven to rotate in the clockwise direction by a drive means 10. The fusing belt 1 moves following the rotation of the pressure roller 4. At this time, the portion P on the downstream part of the fusing belt 1 is stretched in the left and right directions in the figure compared to when the fusing belt 1 is stationary. Conversely, the portion Q on the upstream part is loosened in the left and right directions in the figure compared to when the fusing belt 1 is stationary. The roller 51 of the oil application device 5 is brought into contact with the area at the downstream side lower than the midpoint portion between the fusing roller 2 and the heating roller 3 or, in other words, the heating roller 3 side within the portion Q at which the loosening occurs. By setting the roller 51 at this type of position, jumping at the portion where the fusing belt 1 dips into the heating roller 3 can be suppressed. Moreover, in this embodiment, the inner peripheral surface of the fusing belt 1 rubs against the outer peripheral surface of the fusing roller 2 and the heating roller 3. Therefore, it is preferable for the friction coefficient of both the inner peripheral surface of the fusing belt 1 and the outer peripheral surface of the fusing roller 2 and the heating roller 3 to be small.

Figure 9:
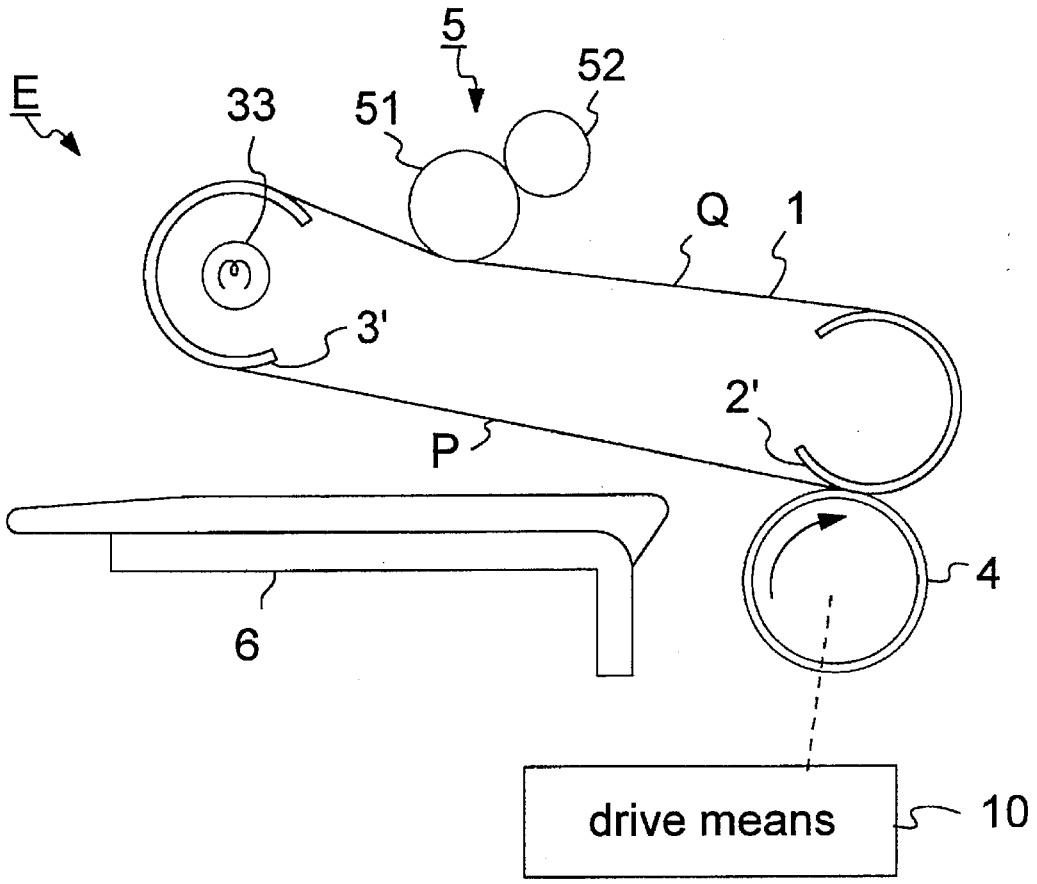
FIG. 9 is a cross-sectional view showing another embodiment of the fusing device related to this invention.

Another embodiment E of the present invention is illustrated in FIG. 9. Embodiment E differs from embodiment D of FIG. 8 in that the embodiment E uses stationary devices having curved surfaces, instead of rollers, to support the belt 1. In FIG. 9, a fusing support 2' and a heating support 3' are securely installed in a nonrotatable manner. The fusing support 2' is somewhat C shaped (in cross section) and includes a curved surface having a radius sufficient to support the belt 1. The heating support 3' has a shape similar to that of the fusing support 2', and further includes a heater 33 inside it. The outer surfaces of the fusing support 2' and the heater support 3' have a low coefficient of friction so that the belt is able to rotate over their outer surfaces.

The fusing belt 1 is stretched around these supports 2' and 3'. In addition, a pressure roller 4 is rotatably provided opposite the fusing support 2'. The pressure roller 4 is driven to rotate in the clockwise direction by a drive means 10. The fusing belt 1 moves following the rotation of the pressure roller 4.

The portion P on the downstream part of the fusing belt 1 is stretched, i.e., in tension, compared to when the fusing belt 1 is stationary. Conversely, the portion Q on the upstream part is in a relaxed, i.e., unstretched state, compared to when the fusing belt 1 is stationary. The roller 51 of the oil application device 5 is brought into contact with the area at the downstream side lower than the midpoint portion between the fusing support 2' and the heating support 3' or, in other words, the heating support 3' side within the portion Q at which the loosening occurs. By setting the roller 51 at this position, jumping at the portion where the fusing belt 1 dips toward the heating support 3' can be suppressed. Moreover, in this embodiment, the inner peripheral surface of the fusing belt 1 rubs against the outer peripheral surface of the fusing support 2' and the heating support 3'. Therefore, it is preferable for the friction coefficient of both the inner peripheral surface of the fusing belt 1 and the outer peripheral surface of the fusing support 2' and the heating support 3' to be small.

Alternatively, the fusing support 2' and the heater support 3' may be combined as one integral structure.

The foregoing teachings may be applied to other types of belt devices, in addition to, or instead of the specific fusing devices disclosed above. For example, the same concepts may be applied to a belt feed mechanism used in a document feed device or in a belt feed device used in a belt photoreceptor.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A belt transporting device, comprising:

a first roller;

a second roller which is substantially parallel to said first roller;

an endless belt which extends around said first roller and said second roller along with a belt path, said belt being connected to said second roller so that said second roller is driven by rotating of said belt;

means for rotating said belt in a belt rotating direction; and a member which is in contact with said belt at a first position between said first roller and said second roller, a distance between said first position and said second roller is shorter than a distance between said first position and said first roller, said first position is upstream of said second roller along the belt path in the belt rotating direction, wherein said member contacts said belt so as to induce a predetermined tension in said belt.

2. The belt transporting device as claimed in claim 1, wherein said member is spaced from said second roller.

3. The belt transporting device as claimed in claim 1, wherein said member is in contact with said second roller via said belt.

4. The belt transporting device as claimed in claim 1, wherein said belt has an inner surface and an outer surface, said inner surface being in contact with said first roller and said second roller, said outer surface being in contact with said member.

5. The belt transporting device as claimed in claim 4, further comprising:

a heater which is provided in said second roller;

said member includes means for providing a release agent onto said outer surface; and said outer surface is coated with the release agent.

6. The belt transporting device as claimed in claim 1, wherein the means for rotating said belt in the belt rotating direction includes a driver which is connected with said first roller to rotate said first roller, wherein said belt is driven by rotation of said first roller.

7. The belt transporting device as claimed in claim 1, further comprising a third roller which is in contact with said first roller via said belt; and the means for rotating said belt in the belt rotating direction includes a driver which is connected with said third roller to rotate said third roller;

wherein said belt is driven by rotation of said third roller.

8. The belt transporting device as claimed in claim 1, wherein said second roller has a pair of flanges on an outer surface thereof.

9. The belt transporting device as claimed in claim 1, wherein said first position is adjacent said second roller.

10. The belt transporting device as claimed in claim 1, wherein said member includes an oil application roller for applying oil to the endless belt.

11. The belt transporting device as claimed in claim 10, further comprising an oil supply roller in contact with the oil application roller for supplying oil to the oil application roller.

12. The belt transporting device as claimed in claim 11, further comprising a cleaning member in contact with the oil application roller.

13. A belt transporting device comprising:

a first member which has a first curved surface;

a second member which has a second curved surface, said second curved surface being provided substantially parallel to said first curved surface;

an endless belt which extends around the curved surfaces of said first member and said second member;

a driver which drives said belt in a belt rotating direction so as to create slack at a first position between said first member and said second member, said first position is upstream of the second member with respect to the belt rotating direction; and a third member which is in contact with said belt at the first position, and a distance between said third member and said second member is shorter than a distance between said third member and said first member.

14. The belt transporting device as claimed in claim 13, wherein said third member is spaced from said second member.

15. The belt transporting device as claimed in claim 13, wherein said third member contacts said belt so as to induce a predetermined tension in said belt.

16. The belt transporting device as claimed in claim 13, wherein said belt has an inner surface and an outer surface, said inner surface being in contact with said first member and said second member, and said outer surface being in contact with said third member.

17. The belt transporting device as claimed in claim 16, further comprising:

a heater provided in said second member, wherein said third member includes means for providing a release agent oil onto said outer surface, and said outer surface is coated with the release agent oil.

18. The belt transporting device as claimed in claim 13, wherein said driver comprises a roller which is in contact with said first member via said belt, said roller being provided rotatably, said belt being driven by rotation of said roller.

19. The belt transporting device as claimed in claim 13, wherein said second member has a pair of flanges on an outer surface thereof.

20. The belt transporting device as claimed in claim 13, wherein said first position is adjacent said second member.

21. The belt transporting device as claimed in claim 13, wherein said first member and said second member are each substantially cylindrical in shape.

22. The belt transporting device as claimed in claim 13, wherein said first member and said second member are each substantially C shaped in cross section.

23. The belt transporting device as claimed in claim 22, wherein said first member and said, second member are integrally connected to each other.

24. The belt transporting device as claimed in claim 22, wherein the belt transporting device is a fusing device.

25. The belt transporting device as claimed in claim 13, wherein the belt transporting device is a part of an automatic document feeder.

26. The belt transporting device as claimed in claim 13, wherein the belt transporting device is a part of a photoreceptor.

27. The belt transporting device as claimed in claim 13, wherein said third member includes an oil application roller for applying oil to the endless belt.

28. The belt transporting device as claimed in claim 27, further comprising an oil supply roller in contact with oil application roller for supplying oil to the oil application roller.

29. The belt transporting device as claimed in claim 28, further comprising a cleaning member in contact with the oil application roller.

30. A fusing device, comprising:

a first member which has a cylindrical shape;

a second member which has a cylindrical shape, said second member being provided substantially parallel to said first member;

a heater provided in said second member for heating the second member;

an endless belt which extends around said first member and said second member, said endless belt being heated by said second member;

a driver which drives said belt in a belt rotating direction so as to create slack at a first position between said first member and said second member, said first position being upstream of said second member with respect to the belt rotating direction, and a third member which is in contact with said belt at the first position, a distance between said third member and said second member is shorter than a distance between said third member and said first member.

31. The fusing device as claimed in claim 30, wherein said third member is in contact with an outer surface of said belt to apply a release agent onto said outer surface.

32. The fusing device as claimed in claim 31, wherein said outer surface is coated with the release agent.

33. The fusing device as claimed in claim 30, further comprising a rotatable roller which is in contact with said first member via said belt so as to accept a sheet on which a toner image is formed inserted between said belt and said roller to fuse the toner image onto said sheet.

34. The fusing device as claimed in claim 33, wherein said roller is connected with said driver.

35. The fusing device as claimed in claim 33, wherein said roller is connected with said first member.

36. The fusing device as claimed in claim 30, wherein said second member includes a pair of flanges.

37. The fusing device as claimed in claim 30, wherein said third member includes an oil application roller for applying oil to the endless belt.

38. The fusing device as claimed in claim 37, further comprising an oil supply roller in contact with the oil application roller for supplying oil to the oil application roller.

39. The fusing device as claimed in claim 38, further comprising a cleaning member in contact with the oil application roller.

40. A method for constructing a belt transporting device, wherein the device includes a first member which has a first curved surface; a second member, which has a second curved surface, so that said second curved surface is substantially parallel to said first curved surface; an endless belt around the curved surfaces of said first member and said second member; and a drive source, which drives said belt, in a belt rotating direction so that said belt creates slack at a first position between said first member and said second member, said first position being upstream of the second member with respect to the belt rotating direction; comprising the steps of:

defining a specific position of said first position so that a distance between the specific position and said second member is shorter than a distance between the specific position and said first member, and contacting a third member with said belt at the specific position.

* * * * *